US005722917A

United States Patent [19]

Olschansky et al.

[11] Patent Number: 5,722,917

[45] Date of Patent: Mar. 3, 1998

[54] DISPLACEABLE SEAT EXERCISE SYSTEM

[75] Inventors: Brad Olschansky; Scott Olschansky, both of Smyrna, Ga.; Joel D. Gordon, Pikesville, Md.

[73] Assignee: Exerfun, Inc., Smyrna, Ga.

[21] Appl. No.: 715,447

[22] Filed: Sep. 18, 1996

[51] Int. Cl.[6] ..... A63B 69/06

[52] U.S. Cl. ..... 482/72; 482/96; 482/130; 482/145

[58] Field of Search ..... 482/62, 72, 95, 482/96, 132, 145, 129, 130

[56] References Cited

U.S. PATENT DOCUMENTS

| | | |
|---|---|---|
| D. 357,041 | 4/1995 | McBride et al. . |
| 2,470,544 | 5/1949 | Bell . |
| 3,446,503 | 5/1969 | Lawton . |
| 4,300,760 | 11/1981 | Bobroff . |
| 4,684,126 | 8/1987 | Dalebout et al. . |
| 4,700,946 | 10/1987 | Breunig . |
| 4,743,010 | 5/1988 | Geraci . |
| 4,850,585 | 7/1989 | Dalebout . |
| 4,943,051 | 7/1990 | Haskins et al. . |
| 5,145,479 | 9/1992 | Olschansky et al. . |
| 5,299,997 | 4/1994 | Chen . |
| 5,342,269 | 8/1994 | Huang et al. . |
| 5,356,357 | 10/1994 | Wang et al. . |
| 5,370,594 | 12/1994 | Grinblat . |
| 5,445,583 | 8/1995 | Habing . |
| 5,453,066 | 9/1995 | Richter, Jr. . |
| 5,458,553 | 10/1995 | Wu . |
| 5,503,608 | 4/1996 | Chang . |
| 5,505,679 | 4/1996 | McBride et al. . |
| 5,507,709 | 4/1996 | Wu . |
| 5,507,710 | 4/1996 | Chen . |

*Primary Examiner*—Lynne A. Reichard

*Attorney, Agent, or Firm*—Morton J. Rosenberg; David I. Klein; Jun Y. Lee

[57] ABSTRACT

A displaceable seat exercise system (10) is provided wherein a user's legs and arms may be independently exercised. A seat assembly (40) is rotatively coupled to a base frame (12) by means of a parallelogram linkage assembly (90). The user displaces seat assembly (40) by extending his or her legs against a stationary foot support assembly (80), the foot support assembly being affixed to the base frame (12). Seat assembly (40) carries an arm member support assembly (50) which includes a pair of rotary resistance assemblies (120, 130) and respective rotatively coupled arm members (64, 62) for rotation by each of the user's arms, respectively. Seat assembly (40) may be collapsed into juxtaposition over base frame (40) and partially overlaid by the foot platform (88) to releasably secure exercise system (10) in a compact storage configuration.

28 Claims, 6 Drawing Sheets

DISPLACEABLE SEAT EXERCISE SYSTEM

BACKGROUND OF THE INVENTION

Field of the Invention

This invention is directed to an exercise system that allows the user to exercise, either in combination or separately, his arms, and legs. Particularly, this invention is directed to an exercising system wherein the arms are exercised by their displacement in a rotary motion, against separate rotary resistance forces. The legs are exercised by rotational displacement of a seat assembly relative to a foot support assembly, the user's legs being exercised against a resistive force formed by the combination of the user's own body weight and/or a resistive element. Still further, this invention is directed to an exercise system wherein the seat assembly is rotatively coupled to a base frame by means of a parallelogram linkage, the interaction between the seat assembly and the parallelogram linkage creating a stop for establishing the initial starting position of the seat assembly. More in particular, this invention pertains to an exercise system which may be collapsed into a compact structure for storage and transport. The collapsed state is reversibly maintained by displacing the foot support portion of the system into overlaying relationship with the collapsed seat assembly.

Prior Art

Exercise systems having displaceable seats, separate upper and lower body exercising capabilities, or exercise systems utilizing rotary resistance elements are known in the art. The best prior art known to the Applicant includes U.S. Pat. Nos. #5,505,679; #D357,041; #4,943,051; #5,370,594; #3,446,503; #5,342,269; #2,470,544; #5,458,553; #5,299,997; #5,356,357; #5,507,709; #4,700,946; #4,300,760; #5,503,608; #5,453,066; #5,445,583; #5,507,710; #4,743,010; #5,145,479; #4,850,585; and, #4,684,126.

In some prior art systems, such as that disclosed in U.S. Pat. No. #2,470,544, leg muscles are utilized to displace the user's body weight by displacement of a seat upon which the user is seated. However, the seats of such systems are coupled to a foot pedal carrying yoke by an inelastic connecting rod, with the yoke being pivotally coupled to the device's frame through a bearing. Thus, in such systems the pedals are displaced by the user's feet to cause the displacement of the seat. Such systems provide no means for exercising the user's arms, and do not provide for a collapsed easily storable structure.

In other prior art systems, such as that disclosed by U.S. Pat. No. #3,446,503, a pull type exercising device is provided. Such prior art systems have footrests which remain fixed in position during use of the machine. Each footrest is slidably coupled to respective rails of the machine, but are frictionally engaged therewith when the user applies force thereto. The user of such systems displaces a seat that is rotatively coupled to a base frame by a parallelogram linkage. However, such systems further include an actuating bar against which the user pulls to simultaneously exercise both the arms and legs, the resistive load formed by the user's body weight being shared by both arm and leg muscles. Further, the footrests do not provide any means for releasably maintaining the device in a collapsed position.

In still other prior art systems, such as that disclosed by U.S. Pat. No. #5,445,583, a slidably displaced backrest is provided which displacement is responsive to extension of the user's legs. Initially, the user displaces the backrest by pushing against footpads attached to beams. Although such beams are pivotally coupled to the frame, during the initial portion of the exercise the resistance to displacement applied to the beams is greater than the force required by the user to raise his or her body weight on the sliding backrest. Once in the raised position, the user then commands the system to reduce the resistance force, whereby the user may then perform a striding type exercise while in an elevated "floating" position. However, such systems do not provide for simultaneous and independent exercise of the user's arms, and do not provide for a collapsible structure to make storage and transport more efficient.

While prior art systems capable of providing independent exercise for both the upper and lower body portions of a user are known, as disclosed in U.S. Pat. No. #5,145,479, such systems require the user's legs and arms to be exercised utilizing a rotary motion. In such systems, the legs were exercised against a frictional resistance force formed by a band-break type arrangement, and therefore did not make use of the user's own body weight to provide a resistive force. Further, such systems provided no means for collapsing the structure into a compact arrangement for storage and transport.

SUMMARY OF THE INVENTION

A displaceable seat exercise system is provided. The displaceable seat exercise system comprises a base frame extending longitudinally between opposing first and second ends. A foot support assembly is included that is fixedly coupled to the first end of the base frame. The exercise system further includes a seat assembly that is rotatively coupled to the second end of the base frame, the seat assembly including (a) a seat support member extending longitudinally between opposing front and rear ends thereof for supporting a buttock portion of a user's body, (b) a spine support member pivotally coupled to the seat support member adjacent the rear end thereof for supporting a user's back, the pivotal coupling between the seat and spine support members defining a pivotal axis of the spine support member, the pivotal axis being displaced a predetermined distance from one end of the spine support member, and (c) a parallelogram linkage assembly for rotatively coupling both the seat and spine support members to the base frame. The exercise system further comprises a resistance assembly coupled between the base frame and the seat assembly for resisting a force applied by a user between the foot support assembly and the seat assembly to rotatively displace the seat assembly from a position proximate the foot support assembly.

DESCRIPTION OF THE PREFERRED EMBODIMENTS

Figure 1:
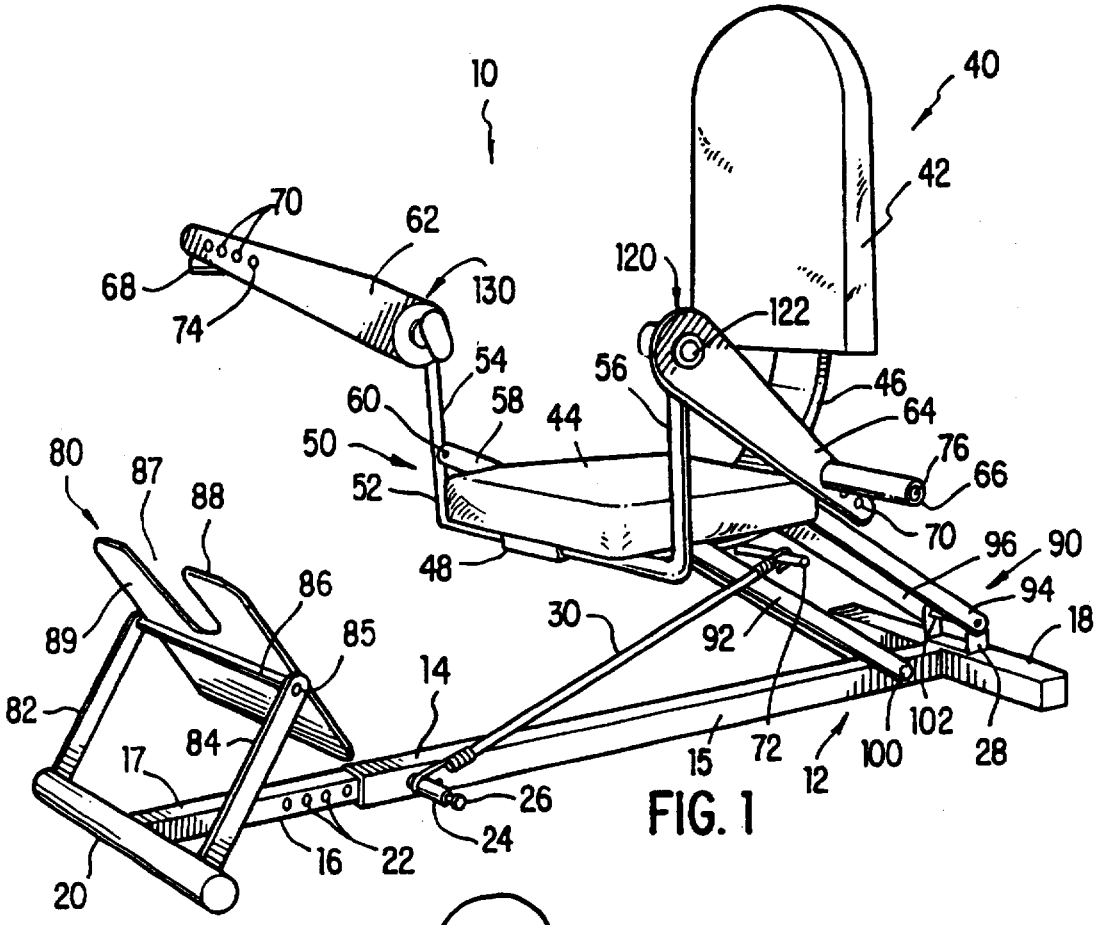
FIG. 1 is a perspective view of the exercise system of the present invention.

Referring to FIGS. 1–12, there is shown displaceable seat exercise system 10 for providing resistive loading force against which a user exercises. Exercising system 10 provides separate and independent resistive loading force to the arms and legs of the user. In overall concept, system 10 provides a loading force against which the user's legs are exercised, where a portion of such loading force is contributed by the user's body weight. The user's legs are exercised by displacement of a seat assembly 40 which is cantilevered from a parallelogram linkage assembly 90, with the remaining portion of the resistance force being provided by a resistance assembly formed by one or more resistance elements 30. The unique and novel structure provided by the displaceable seat exercise system 100 permits the user's legs to be exercised, the user's arms to be exercised, or both the user's arms and legs to be exercised simultaneously, but with independent resistance loading forces for each. In fact, users can utilize system 10 to exercise their arms simultaneously, but to different degrees of loading, as separate rotary resistance assemblies 120, 130 provide independent loading to each arm of the user.

Further, displaceable seat exercising system 10 is directed to the general concept of an exercise system which takes advantage of the user's own body weight to provide a resistive force against which the user exercises. Still further, system 10 provides a seat assembly 40 which is cantilevered, and thereby maximizes access to seat assembly 40 and provides for a more compact structure for storage. Additionally, system 10 includes a pair of arm members 62, 64 with respective handles 68, 66 pivotally coupled thereto, each arm member 62, 64 being coupled to a respective rotary resistance assembly 130, 120 which provide a force resistant to rotation of each respective arm member, irrespective of the direction of the user applied rotative driving motion applied to the respective handle members. Further, the novel structure of exercise system 10 allows the seat assembly 40 to be collapsed into a compact form. Seat assembly 40 is secured in the collapsed state by means of the foot support assembly 80 to provide a compact package for storage or transport of system 10.

Figure 10:
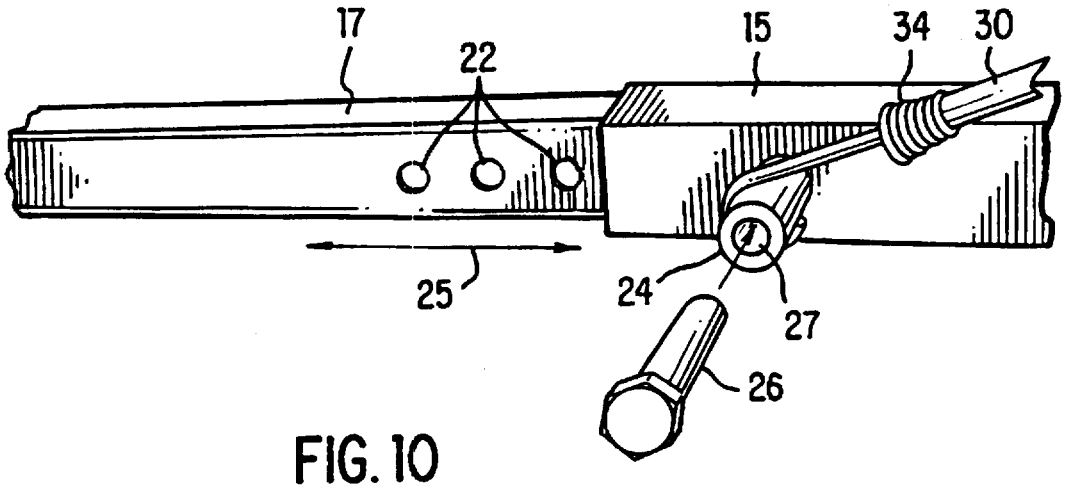
FIG. 10 is a partially sectioned view of a portion of the base frame of the present invention.

Referring now to FIGS. 1 and 10, displaceable seat exercising system 10 is shown to include a base frame 12 having a front frame section 16 telescopically coupled to a rear frame section 14. A seat assembly 40 is pivotally coupled to a rear end of the rear frame section 14 and a foot support assembly 80 fixedly coupled to a front end portion of the front frame section 16. Rear frame section 14 of the base frame 12 is formed by a rear tubular member 14 coupled to a rear cross leg 18, in a T-shaped configuration. Front frame section 16 of base frame 12 is formed by a front tubular member 17 coupled to a front cross leg 20, also arranged in a T-shaped configuration. Front tubular member 17 is telescopically received within the rear tubular member 15.

Front tubular member 17 is manufactured with a plurality of through openings 22 formed through a side wall thereof for receiving one end of a pin 26 therein, to releasably secure front frame section 16 to rear frame section 14. By means of the plurality of through openings 22, the relative position of foot support assembly 80 can be adjusted relative to seat assembly 40, to suit the physical characteristics of the user, as well as to subsequently maintain system 10 in a collapsed state. Pin 26 extends through a sleeve 24 which is secured to a corresponding side of the rear tubular member 15. Sleeve 24 has a through bore 27 which is axially aligned with an aperture formed in the tubular member 15 so that the pin 26 passes therethrough and into a selected one of the plurality of through holes 22 of tubular member 17. In this manner, the tubular member 17 may be extended or retracted, as indicated in FIG. 10 by directional arrow 25, to adjust the position of foot support assembly 80, either for use or for storage of system 10.

Foot support assembly 80 is fixedly coupled to the front cross leg 20 of base frame 12 by means of a pair of foot support members 82 and 84 extending upwardly therefrom. Between the support members 82 and 84, a foot platform 88 is pivotally coupled. Foot platform 88 is a substantially rectangular planar member having a cut-out portion 87 formed in one edge thereof, the function of which will be described in following paragraphs. Foot platform 88 includes a pivot rod 86 secured to a rear surface 89 thereof and extending laterally between the support members 82 and 84. Pivot rod 86 extends through respective openings 85 formed in the distal ends of supports 82 and 84 to provide a pivotal coupling between support members 82 and 84 and foot platform 88. Thus, while foot platform 88 is rotatable with respect to the supports 82 and 84, such provides a fixed base against which the user may apply a displacement force, for displacing seat assembly 40 relative to the base frame 12.

Figure 2:
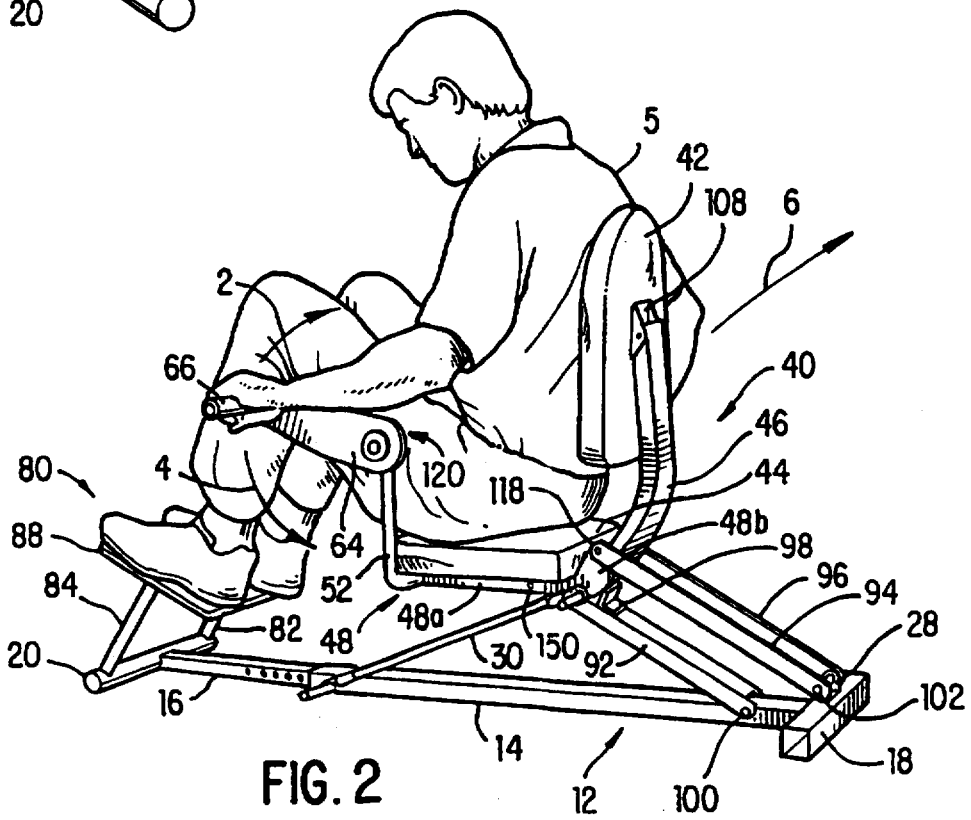
FIG. 2 is a perspective view showing the present invention with a user in an initial operating position.
Figure 5:
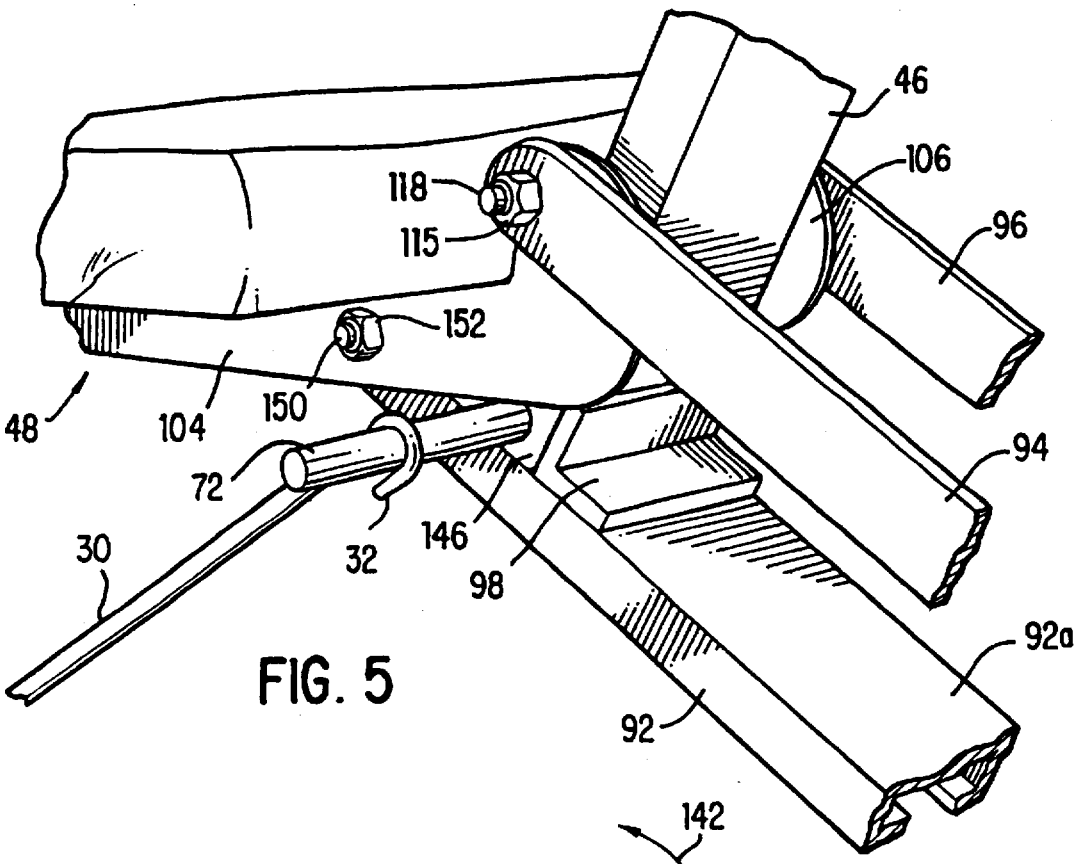
FIG. 5 is a partially sectioned perspective view of the present invention depicting the coupling of the parallelogram linkage to the seat assembly.

With additional reference to FIGS. 2 and 5, seat assembly 40 is shown to include a seat support 48 pivotally coupled to the base frame 12 by means of the linkage assembly 90. A spine or back support member 46 is pivotally coupled to the seat support 48 adjacent one end thereof, and is coupled to a back cushion 42 at the opposing end by means of a bracket 108. Seat support 48, in addition to providing coupling to the base frame 12, secures and supports the seat cushion 44. As will be discussed in following paragraphs, seat support 48 also is coupled and supports the arm member support assembly 50, which includes a pair of rotatable arm members 62 and 64 coupled to a pair of rotary resistance assemblies 130, 120, respectively.

Seat assembly 40 is rotatively coupled to a rear end portion of base frame 12 for displacement responsive to extension of the user's legs against the foot platform 88. One method of providing such rotative coupling is by means of a parallelogram linkage type assembly. Unlike prior art parallelogram linkages in exercise systems wherein the parallel sets of linkages are disposed at opposing ends of a displaceable seat, parallelogram linkage assembly 90 is pivotally coupled to seat assembly 40 at a rear portion **48*b* of seat support 48, adjacent the coupling between the back support member 46 and seat support 48, providing a cantilever support arrangement. The cantilever arrangement provides structural support for seat assembly 40 without interfering with other structures of system 10, or the user. Further, by maintaining the parallel linkages in close proximity to each other, a rotational stop is formed by the end portion 146 of back support member 46**.

The end portion 146 of back support member 46 contacts the upper surface 92*a* of the link member 92 when link member 92 is disposed at a predetermined angle with respect to its pivotal coupling to base frame 12. Thus, the extension 146 of back support member 46, beyond its pivotal coupling 118 to the seat support 48, to contact the upper surface 92*a* of link 92 when such is at the predetermined angle, functions to limit the rotation of seat assembly 40 relative to base frame 12 in one direction. The angle at which the seat assembly is positioned relative to the parallelogram pivot points at the base frame defines the initial starting position for exercising a user's legs. Link member 92 is coupled on one end to seat support 48 by a pivot shaft 150, and on the opposing end to rear tubular member 15 by a pivot shaft 100, adjacent the tubular member's coupling to rear cross leg 18. In one working embodiment, link member 92 is formed by a channel-shaped member, but may also be formed by a pair of spaced parallel linkages, like linkage members 94 and 96.

Linkage members 94 and 96 together form the portion of the parallelogram linkage assembly that operates in parallel with linkage member 92. Linkage members 94 and 96 are disposed in spaced parallel relationship, each being coupled on one end to the rear cross leg 18 of base frame 12 by a pivot shaft 102, and on the opposing end to the rear end portion 48*b* of seat support 48 by a pivot shaft 118. The pivotal coupling of linkages 94 and 96 by pivot shaft 118 is at the common pivotal connection between back support member 46 and seat support 48. As shown, link members 94 and 96 are pivotally coupled to base frame 12 by means of a U-shaped bracket 28 secured to the rear cross leg 18, with pivot shaft 102 extending therebetween, thereby placing the pivotal connection of link members 94 and 96 at a higher elevation than the pivotal connection 100 of link member 92. In one working embodiment, the center-to-center distance between the pivotal coupling 102 of linkages 94 and 96 and the pivotal coupling 100 of linkage 92 approximates 5", as does the spacing between pivotal coupling locations of pivot shafts 150 and 118, on opposing ends of the respective linkage members. As link members 94 and 96 and link member 92 are part of a parallelogram linkage arrangement, the location of pivotal connection 118 of members 94 and 96 must be at a higher elevation than pivotal connection 150 for member 92. Seat support 48 is therefore contoured at the rear portion 48*b* to provide coupling with link member 92 at one elevation and coupling with link members 94 and 96 and back support member 46 at a higher elevation. Although the link members 94 and 96 are separate and distinct members in the illustrated embodiment, they could be replaced by a single channel-shaped member like member 92, with appropriate cut-out portions formed in opposing ends thereof to provide the necessary clearances, without departing from the inventive concepts embodied in system 10.

In addition to the user's own body weight, system 10 may include one or more resistance elements 30 coupled between seat assembly 40 and base frame 12. Where multiple resistance elements are employed, the resistance elements are coupled in parallel between seat assembly 40 and base frame 12. Resistance element 30 is coupled to seat assembly 40 by an end coupling 32 releasably coupled to a rod member 72, rod member 72 being secured to the end 146 of back support member 46 and extending laterally therefrom.. The opposing end of resistance element 30 has an end coupling 34 that is releasably coupled to rear tubular member 15 of base frame 12 by securement to the sleeve 24. Both sleeve 24 and rod member 72 extend laterally a sufficient distance to permit the coupling of multiple parallel resistance elements to provide for increasing resistive force against which the user exercises.

Figure 3:
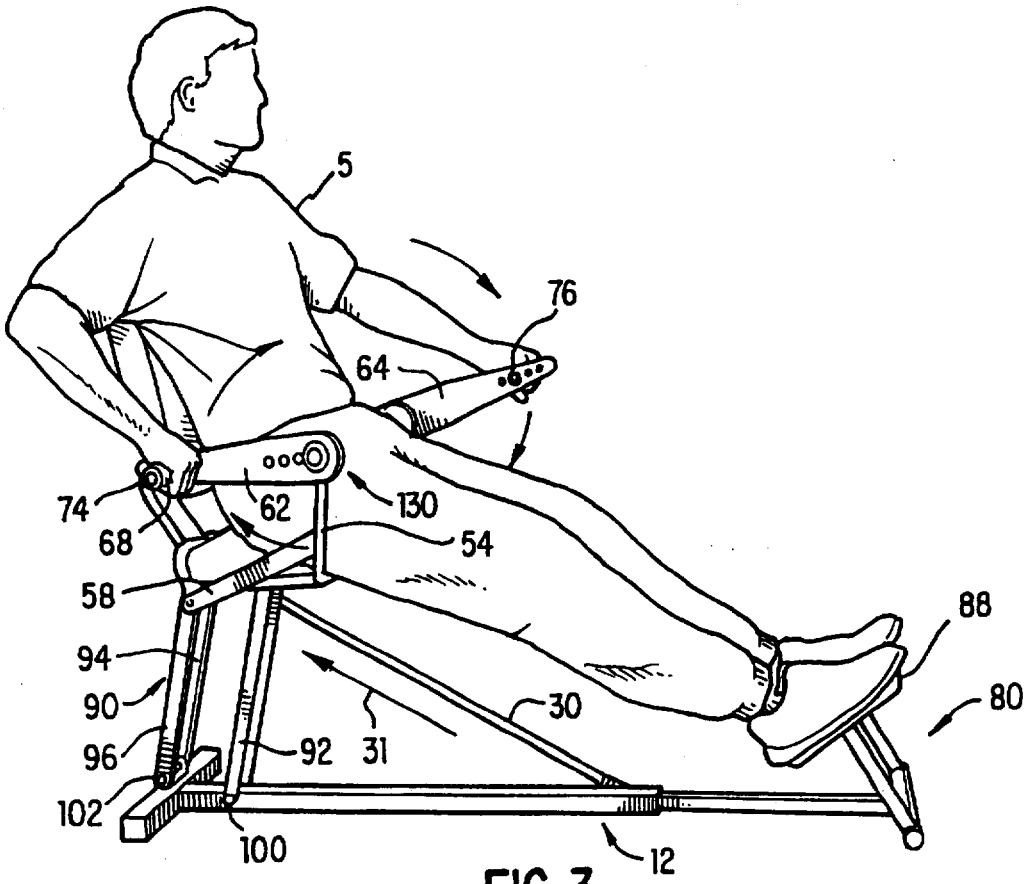
FIG. 3 is a depiction of the present invention in operation.
Figure 4:
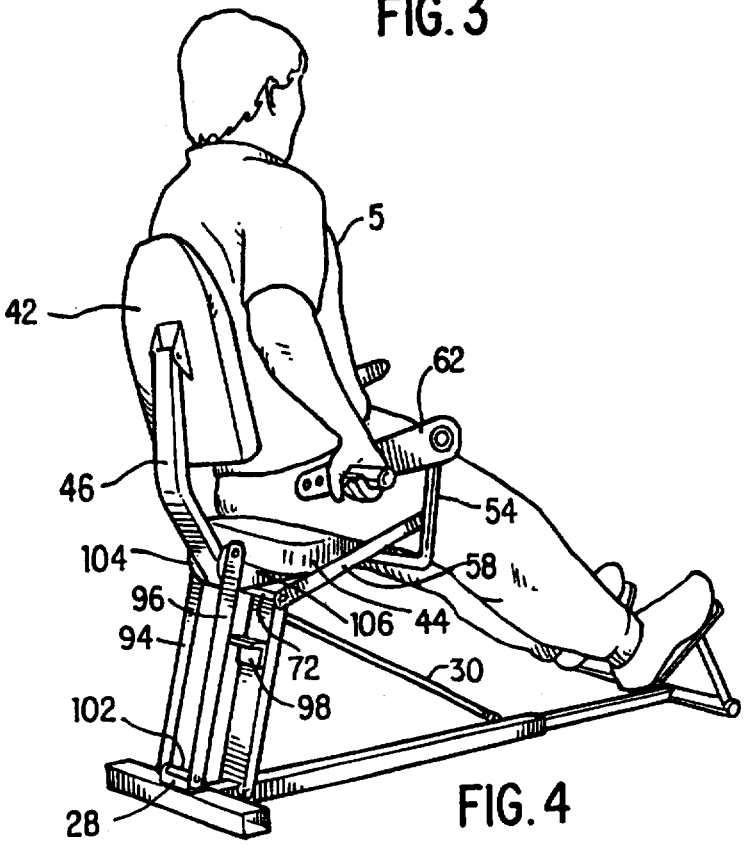
FIG. 4 is a rear perspective view of the present invention in operation.

As further shown in FIGS. 2, 3 and 4, the user 5 adjusts the front frame section 16 relative to the rear frame section 14 so that the user's legs are close to the user's torso when the user's feet are positioned on the foot platform 88, with the user seated on seat cushion 44. The user may grasp the handles 66 and 68 and rotate the respective arm members 64 and 62 in either of two opposite directions, as indicated by directional arrows 2 and 4. The user's rotation of arm members 64 and 62 is resisted by respective rotary resistance assemblies 120 and 130, the resistive force provided thereby being independently adjustable. The exercise of the user's legs is accomplished by the user's displacement of seat assembly 40 rotatively about the pivot axes formed by pivot shafts 100 and 102, as indicated by directional arrow 6. The user accomplishes the displacement of seat assembly 40 by extension of his or her legs. As the foot support assembly 80 is fixed to base frame 12, the user utilizes his or her leg muscles to overcome the resistance force provided by the combination of resistance element 30 and the user's own body weight. That motion can then be reversed, with the user slowly returning seat assembly 40 to its original position, resisting the aforementioned combined forces which now act to return the seat assembly to its initial position.

In one working embodiment, resistance element 30 is formed by one or more elastic elements which are stretched in a direction indicated by directional arrow 31 as the user's legs are extended, and returns to its initial length with the return of seat assembly 40 to its initial position. The elastic element 30 may be a non-metallic flexible elastic member, such as a bungee cord, or a metallic spring structure. Alternately, other types of resistance elements may be utilized in lieu of the flexible elastic element 30, such as gas springs, pneumatic or hydraulic resistive elements, as well as mechanical or electrical resistive elements. As the arm member support assembly 50 is displaced along with seat support 48, the user is able to maintain his or her arm motion as the user's legs are exercised. Further, as the arm exercise resistance elements 120 and 130 are separate and distinct from the leg exercise resistance elements, each may be utilized independently of the other, or used simultaneously.

As previously discussed, the end portion 146 of back support member 46 forms a stop in conjunction with an upper surface portion of linkage member 92, establishing the initial starting or resting position of seat assembly 40. Rod member 72, in addition to serving as a coupling for resistive element 30, functions as a stop to limit the displacement of seat assembly 40. Rod member 72 is displaced rearwardly with the back support member 46, which in turn moves rearwardly with seat support 48. The rearward displacement of seat assembly 40 is stopped when the rearwardly displaced rod member 72 contacts the link members 94 and 96, which occurs when the link members 94 and 96 are in a substantially vertical orientation. As will be discussed in following paragraphs, rod member 72 serves two additional functions in the operation of system 10.

Figure 7:
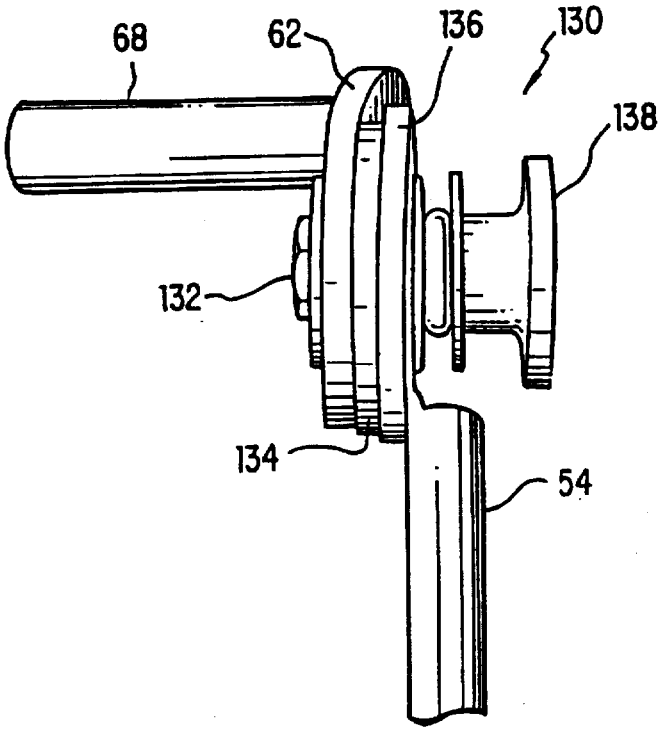
FIG. 7 is a perspective view of one rotary resistive assembly of the present invention.
Figure 8:
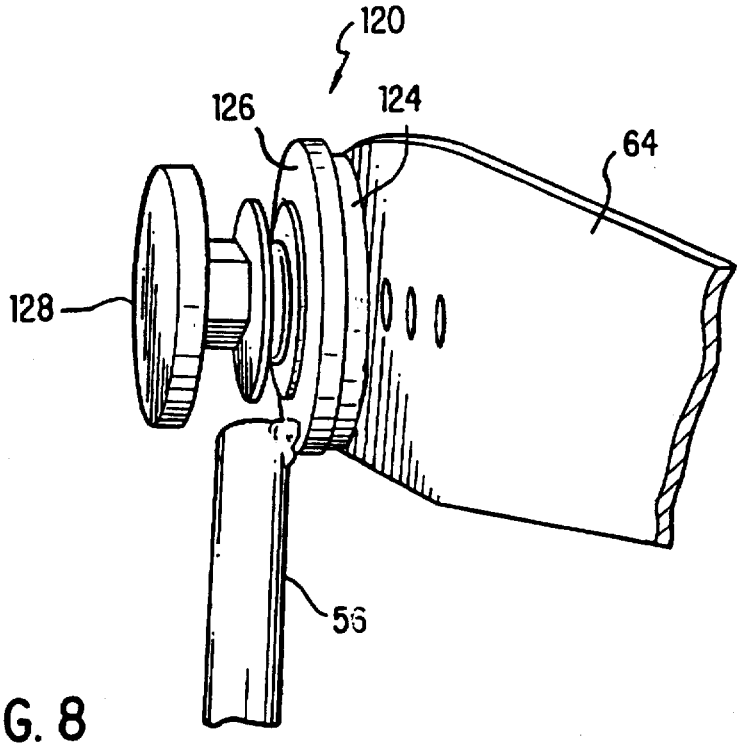
FIG. 8 is a perspective view of another rotary resistive assembly of the present invention.

Referring further to FIGS. 1–4, and additionally to FIGS. 7 and 8, the arm member support assembly will now be further described. The arm member support assembly 50 includes an arm member support 52 which is a U-shaped member pivotally coupled to a forward portion 48*a* of seat support 48 at an intermediate portion arm member support 52, and having first and second extending portions disposed on opposing sides. Each of the extending portions 54, 56 is coupled to respective rotary resistance assemblies 130, 120, to which the respective arm members 62, 64 are rotatively coupled.

Rotary resistance assembly 130 includes a securement plate 136 coupled to the distal end of the extending portion 54 of arm member support 52. The arm member 62 is rotatively coupled to securement plate 136 by means of a pivot shaft 132 extending through coaxial apertures formed in arm member 62 and securement plate 136. Disposed between arm member 62 and securement plate 136 there is provided a friction disk 134 for providing resistance to the rotation of arm member 62 relative to securement plate 136 in either of two opposing directions. Friction disk 134 may be formed of wood, leather, synthetic or natural rubber materials, composite materials, or combinations thereof. An adjustment handle 138 is threadedly coupled to pivot shaft 132, whereby the frictional resistance force between arm member 62 and friction disk 134 may be increased or decreased by respective tightening or loosening of adjustment handle 138 on pivot shaft 132. A handle 68 is pivotally coupled to arm member 62 at the distal end thereof. Arm member 62 is provided with a plurality of handle adjustment openings 70 disposed in longitudinally spaced relationship to permit the handle 68 to be located a selected distance from the rotational axis of arm 62 defined by pivot shaft 132, to suit the user. Handle 68 is coupled to arm member 62 by a handle pivot member 74, the pivot member 74 being coupled to arm member 62 through a selected one of the plurality of apertures 70, by conventional means well known in the art.

Similarly, rotary resistance assembly 120 is coupled to the distal end of the extending portion 56 of arm member support 52. Rotary resistance assembly 120 includes a securement plate 126 which is coupled to the distal end of extending portion 56 of arm member support 52. The arm member 64 is rotatively coupled to securement plate 126 by means of a pivot shaft 122 extending through coaxial openings formed in arm member 64 and securement plate 126. Between arm member 64 and securement plate 126 there is disposed a friction disk 124, formed of the same material composition as friction disk 134 and providing the same functionality. Rotary resistance assembly 120 further includes an adjustment handle 128 that is threadedly coupled to pivot shaft 122, for increasing or decreasing the rotary resistance force between arm member 64 and securement plate 126 by tightening or loosening handle member 128 on the threaded portion of pivot shaft 122. Like arm member 62, arm member 64 includes a plurality of openings 70 formed therethrough and disposed in longitudinally spaced relationship for selected location of a pivotally coupled handle 66. Handle 66 is selectively coupled to one of the plurality of apertures 70 by means of a handle pivot member 76, coupled through the selected aperture 70 by conventional means well known in the art. The adjustable positioning of handle 66 permits the user to locate handle 66 a desired distance from the pivot axis of arm member 64, the pivot axis being defined by pivot shaft 122. It is not beyond the scope of the instant invention to substitute rotary resistance assemblies 120 and 130 for other types of resistance mechanisms, where such are independent of the leg exercise resistance mechanism. Other resistance mechanisms employing magnetic, hydraulic, pneumatic, elastic elements of other frictional devices may be utilized to resist the user's arm motion.

As previously stated, arm member support 52 is pivotally coupled to seat support 48, and therefore must be stabilized so that the user's arms may be exercised without undue displacement of the extended portions 54, 56 of arm member support 52. Such stabilization is provided by the fold link 58 which extends between extending portion 54 of arm member support 52 and one end of rod member 72. Although the fold link 58 is shown to be coupled between the extending portion 54 of arm support member 52 and rod 72, such could be coupled between rod member 72 and the extending portion 56, or alternately, arm member support 52 could be stabilized by a pair of fold links 58, coupled to both extending portions 54, 56 and opposing ends of rod member 72. As will be seen in following paragraphs, in addition to providing stability of the operational position of arm member support 52, fold link 58 provides rotative displacement of arm member support 52 responsive to rotative displacement of back support member 46 when system 10 is being placed into a collapsed state for storage or transport.

Figure 12:
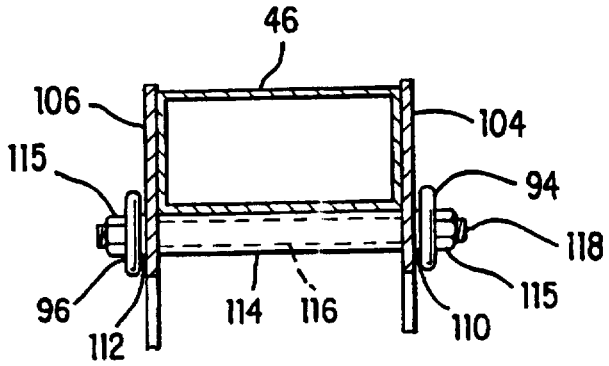

One of the advantages of exercise system 10 over prior art systems is its ability to be collapsed into a compact structure for storage and/or transport. The ability to be collapsed into such a compact form is made possible by the unique combination of structural elements which forms exercise system 10. Referring now to FIGS. 1, 5, 6 and 12, it can be seen that back support member 46 is pivotally coupled to seat support 48 by a pivot member 118. In one working embodiment, back support member 46 has been formed by a tubular member, as shown in FIG. 12. However, the cross-sectional contour of member 46 is of no patentable significance, as the tubular contour is but one method of achieving the necessary structural integrity required for application in an exercise system. Pivot member 118 may be positionally maintained by conventional means, such as by threaded engagement with conventional nuts 115, disposed on one or both ends thereof. Seat support 48 includes a pair of spaced parallel seat support members 104 and 106 adapted for securing seat cushion 44 thereto. The two seat support members 104 and 106 extend on opposing sides of back support member 46. Back support member 46 includes a tubular member 114 coupled thereto, the tubular member 114 having an axial bore 116 through which the pivot member 118 extends, permitting the rotative displacement of back support member 46 relative to seat support members 104 and 106. As shown, the second link members 94 and 96 are also pivotally coupled to the seat support members 104 and 106 by the pivot member 118.

As previously indicated, the end of the lower portion 146 of back support 46 contacts the upper surface **92*a* of the link member 92 and thereby limits the rotative displacement of the seat assembly relative to the base frame 12. However, when the back support member 46 is rotated toward the foot support assembly 80, as indicated by the directional arrow 142 in FIG. 6, the lower portion 146 is displaced from its contact with the first link member 92, permitting the seat assembly 40 to then be further displaced toward the base frame 12, and in fact be juxtaposed therewith. In order to prevent the accidental displacement of back support member 46, a stop member 98 is affixed to the upper surface 92*a* of link member 92 at a position adjacent the location where the portion 146 of back support member 46 contacts link member 92. As seen in FIG. 4, when the user displaces seat assembly 40, the rotative displacement of the parallelogram linkage members 92, 94 and 96 displaces the end of back support member 46 from its position adjacent the stop member 98. However, under that circumstance the user is displacing the seat assembly in an opposite rotative direction from that required to collapse system 10**.

Figure 6:
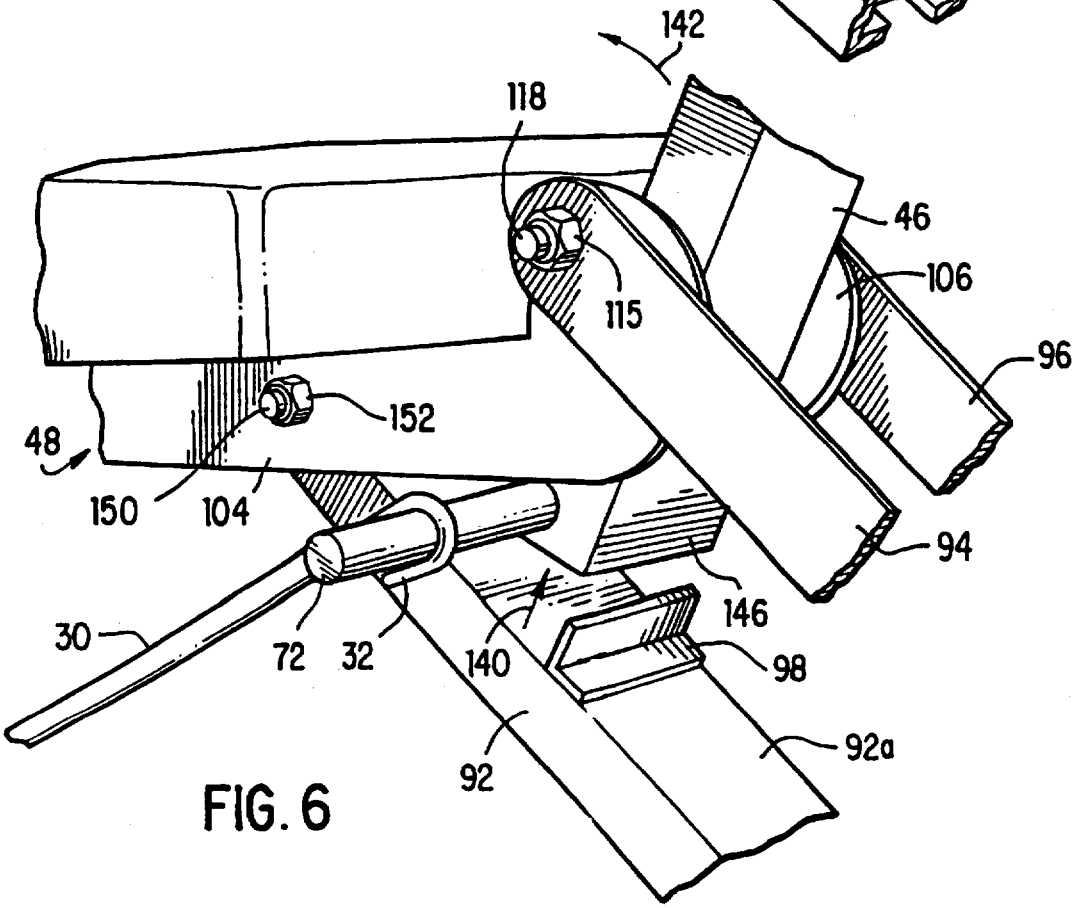
FIG. 6 is a partially sectioned perspective view of the present invention depicting the displacement of the seat assembly relative to the parallelogram linkage.

Thus, in order to collapse exercise system 10 into a compact form, seat assembly 40 must first be displaced toward the rear of base frame 12, which in turn causes the end portion 146 to lift away from the upper surface **92*a* of link member 92, as indicated by directional arrow 140 in FIG. 6. Once the end 146 of back support member 46 has cleared stop member 98, back support member 46 may then be rotated toward the foot support end of base frame 12, as indicated by directional arrow 142. Seat assembly 40 may then be displaced toward the foot support end of base frame 12, to be brought in juxtaposition therewith, as shown in FIG. 11**.

Figure 9:
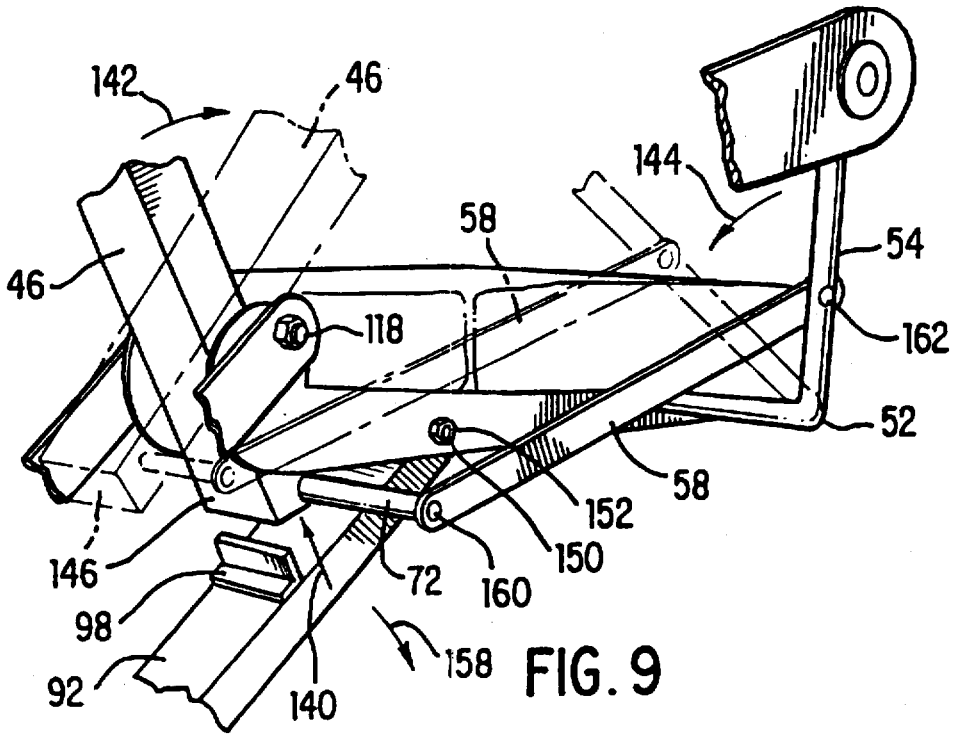
FIG. 9 is a perspective view illustrating the interaction of elements of the present invention when the seat assembly is collapsed.
Figure 11:
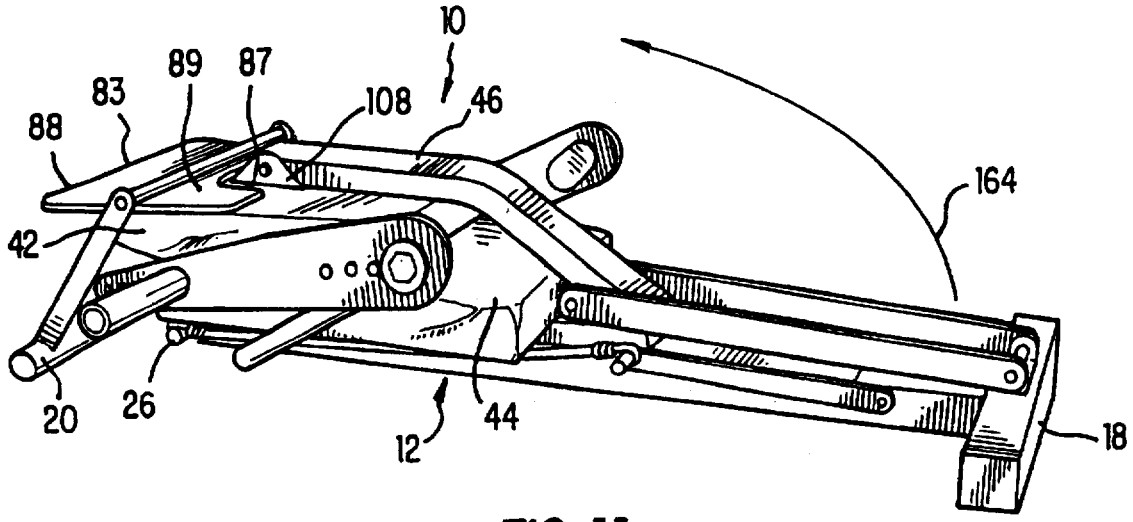
FIG. 11 is a perspective view of the present invention in its compact collapsed state; and, FIG. 12 is a cross-sectional view of a portion of the seat assembly, illustrating the pivotal coupling of the back support to the seat support.

Referring additionally to FIGS. 9 and 11, the structural arrangement of elements which further contribute to the compact collapsed storage and transport configuration of system 10 can be seen. As previously discussed, arm support member 52 is coupled to one end of rod 72 by fold link 58. Fold link 58 is coupled on one end to arm support member 52 by the pivotal coupling element 162 and on the opposing end to rod member 72, at 160. Thus, subsequent to the end 146 of back support member 46 being displaced from link member 92, as indicated by directional arrow 140, to a position above stop member 98, back support member 46 is rotated toward the front end of system 10, as indicated by directional arrow 142. Such rotation of back support member 46 causes the opposing end 146 thereof to be displaced rearwardly, carrying rod member 72 therewith. The rearward displacement of rod member 72 in turn causes arm support member 52 to rotate rearwardly, as indicated by directional arrow 144 and shown in phantom, by virtue of its connection therewith through fold link 58. The seat assembly 40 can then be lowered, the link member 92 being rotated downwardly, as indicated by directional arrow 158 to provide a collapsed structure as shown in FIG. 11.

Subsequent to the seat assembly being collapsed and juxtaposed over base frame 12, the pin 26 is withdrawn from sleeve 24 and then front tubular member 17 can be retracted into rear tubular member 15 to displace the foot support assembly 80 in close proximity to seat assembly 40. As the front tubular member 17 is displaced or preceding such displacement, the foot support platform 88 is rotated such that the bottom surface 89 faces upward and is substantially parallel to base frame 12. Foot platform 88 is displaced toward the rear of system 10 so that the end of back support member 46 and the mounting bracket 108 are positioned within the cut-out portion 87 of platform 88. The length of foot support members 82 and 84 being predetermined to position platform 88 so that the collapsed seat assembly is relatively tightly captured between base frame 12 and platform 88. Lastly, the pin 26 is reinserted into the sleeve 24 to engage an opening 22 in the rear tubular member 17 to maintain the foot platform's position in overlaying relationship with the back of the back cushion 42.

The peripheral edge 83 of foot platform 88 is in substantial alignment with the outer peripheral edge of front cross leg 20. By that arrangement, when rear cross leg 18 is raised and exercise system 10 is rotated relative to front cross leg 20, as indicated by directional arrow 164, exercise system 10 is able to stand vertically supported by peripheral edge 83 of foot platform 88 and front cross leg 20. Thus, when not in use, exercise system 10 can be collapsed to have a minimum profile and thus moved for storage under a bed or other piece of furniture. Alternately, subsequent to collapsing exercise system 10, it may be stood on end for storage in a closet or adjacent wall. Therefore, exercise system 10 provides great convenience for the user, allowing the user to independently or simultaneously exercise both arm and leg muscles, and further, is capable of collapsing into a compact package which may be unobtrusively stored when not in use. The compact collapsed structure also provides for a more efficient manufacturing process, allowing less packing material and labor to be utilized to package exercise system 10 for distribution to retailers and the end user. Further, the compact collapsed structure permits exercise system 10 to be packaged in a substantially assembled state, providing even greater convenience to the user.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

We claim:

1. A displaceable seat exercise system, comprising:

a base frame extending longitudinally between opposing first and second ends;

foot support means fixedly coupled to said first end of said base frame;

seat means rotatively coupled to said second end of said base frame, said seat means including (a) a seat support member extending longitudinally between opposing front and rear ends thereof for supporting a buttock portion of a user's body, (b) a spine support member pivotally coupled to said seat support member adjacent said rear end thereof and displaceable to a first predetermined position for supporting a user's back, said pivotal coupling between said seat and spine support members defining a pivotal axis of said spine support member, said pivotal axis being displaced a predetermined distance from one end of said spine support member, and (c) parallelogram linkage means for rotatively coupling both said seat and spine support members to said base frame; and, resistance means coupled between said base frame and said seat means for resisting a force applied by a user between said foot support means and said seat means to rotatively displace said seat means from a position proximate said foot support means while said spine support member is maintained in said first predetermined position.

2. The displaceable seat exercise system as recited in claim 1 where said seat means includes (a) arm member support means coupled to said seat support member and having portions thereof extending from opposing sides of said seat support member, and (b) a pair of arm members respectively rotatively coupled to said extending portions of said arm member support means for rotation by a user's hands independent of said rotative displacement of said seat means.

3. The displaceable seat exercise system as recited in claim 2 where said seat means includes first rotary resistance means coupled between one of said pair of arm members and a respective extending portion of said arm member support means for applying a force opposing rotation thereof, and second rotary resistance means coupled between the other of said pair of arm members and a respective extending portion of said arm member support means for applying a force opposing rotation thereof.

4. The displaceable seat exercise system as recited in claim 1 where said parallelogram linkage means includes (a) a first link member pivotally coupled to said base frame on a first end thereof and pivotally coupled to said seat support member on a second end of said first link member, and (b) at least one second link member pivotally coupled to said base frame on a first end thereof and pivotally coupled on a second end of said at least one second link member to both said seat and spine support members at said pivotal axis.

5. The displaceable seat exercise system as recited in claim 4 where said one end of said spine support member contacts said first link member to limit said rotative displacement of said seat means in a first direction and establish said position proximate said foot support means.

6. The displaceable seat exercise system as recited in claim 2 where said parallelogram linkage means includes (a) a first link member pivotally coupled to said base frame on a first end thereof and pivotally coupled to said seat support member on a second end of said first link member, and (b) at least one second link member pivotally coupled to said base frame on a first end thereof and pivotally coupled on a second end of said at least one second link member to both said seat and spine support members at said pivotal axis.

7. The displaceable seat exercise system as recited in claim 5 where said seat means includes (a) a pair of arm members rotatively coupled to said seat support member for rotation by a user's hands independent of said rotative displacement of said seat means, (b) an arm member support pivotally coupled to said seat support member and respectively rotatively coupled on opposing ends thereof to said pair of arm members, (c) a rod member fixedly coupled to said spine support member adjacent said one end thereof and extending from opposing sides thereof, said rod member providing a stop to limit said rotative displacement of said seat means in a second direction, said second direction being opposite said first direction, and (d) a fold link member having opposing first and second ends, said first end of said fold link member being pivotally coupled to said arm member support and said second end of said fold link member being pivotally coupled to one end of said rod member for rotatively displacing said arm member support responsive to a rotative displacement of said spine support member relative to said seat support member.

8. The displaceable seat exercise system as recited in claim 7 where said resistance means is coupled to said rod member.

9. The displaceable seat exercise system as recited in claim 8 where said resistance means includes at least one flexible tension member.

10. The displaceable seat exercise system as recited in claim 2 where said seat means includes a pair of handle members, each of said pair of handle members being pivotally coupled to a respective one of said pair of arm members.

11. The displaceable seat exercise system as recited in claim 10 where said seat means includes means for positionally adjusting a location of said pivotal coupling of each of said pair of handle members to said pair of arm members.

12. The displaceable seat exercise system as recited in claim 3 where each of said first and second rotary resistance means include a resistance disk disposed between a respective arm member and a respective extending portion of said arm member support means and concentrically about a rotary axis of a respective arm member.

13. The displaceable seat exercise system as recited in claim 6 where said arm member support means includes an arm support member pivotally coupled to said seat support member and respectively rotatively coupled on opposing ends thereof to said pair of arm members, said seat means further including (a) a rod member fixedly coupled to said spine support member adjacent said one end of said spine support member and extending from opposing sides thereof, said rod member providing a stop to limit said rotative displacement of said seat means in one direction, and (b) a fold link member having opposing first and second ends, said first end of said fold link member being pivotally coupled to said arm support member and said second end of said fold link member being pivotally coupled to one end of said rod member for rotatively displacing said arm support member responsive to a rotative displacement of said spine support member relative to said seat support member.

14. A displaceable seat exercise system comprising:

a base frame extending longitudinally between opposing first and second ends;

foot support means fixedly coupled to said first end of said base frame, said foot support means including (a) a pair of foot support members extending in spaced substantially parallel relationship from said first end of said base frame, and (b) a foot platform member disposed between said pair of foot support members and pivotally coupled thereto;

seat means rotatively coupled to said second end of said base frame, said seat means including (a) a seat support member extending longitudinally between opposing front and rear ends thereof for supporting a buttock portion of a user's body, (b) a spine support member pivotally coupled to said seat support member adjacent said rear end thereof for supporting a user's back, said pivotal coupling between said seat and spine support members defining a pivotal axis of said spine support member, said pivotal axis being displaced a predetermined distance from one end of said spine support member, and (c) parallelogram linkage means for rotatively coupling both said seat and spine support members to said base frame; and, resistance means coupled between said base frame and said seat means for resisting a force applied by a user between said foot support means and said seat means to rotatively displace said seat means from a position proximate said foot support means.

15. A displaceable seat exercise system, comprising:

a longitudinally extended base frame, said base frame including a rear frame member and a front frame member telescopically coupled to said rear frame member;

foot support means fixedly coupled to said front frame member;

seat means rotatively coupled to said second end of said base frame, said seat means including (a) a seat support member extending longitudinally between opposing front and rear ends thereof for supporting a buttock portion of a user's body, (b) a spine support member pivotally coupled to said seat support member adjacent said rear end thereof and displaceable to a first predetermined position for supporting a user's back, said pivotal coupling between said seat and spine support members defining a pivotal axis of said spine support member, said pivotal axis being displaced a predetermined distance from one end of said spine support member, and (c) parallelogram linkage means coupled between said rear frame member and said seat support member for cantilever support thereof and rotative coupling of said seat support and spine support members to said base frame; and, resistance means coupled between said base frame and said seat means for resisting a force applied by a user between said foot support means and said seat means to rotatively displace said seat means from a position proximate said foot support means while said spine support member is maintained in said first predetermined position.

16. The displaceable seat exercise system as recited in claim 15 where said parallelogram linkage means includes (a) a singular first link member pivotally coupled to said rear frame member on a first end thereof and pivotally coupled to said seat support member on a second end of said first link member, and (b) at least one second link member pivotally coupled to said rear frame member on a first end thereof and pivotally coupled on a second end of said at least one second link member to both said seat and spine support members at said pivotal axis.

17. The displaceable seat exercise system as recited in claim 16 where said pivotal axis is positioned at a greater elevation than said pivotal coupling of said first link member second end to said seat support member.

18. The displaceable seat exercise system as recited in claim 17 where said seat means includes a stop member affixed to said first link member for limiting rotative displacement of said spine support member in one direction relative to said seat support member.

19. The displaceable seat exercise system as recited in claim 18 where said spine support member is rotatable relative to said seat support member in said one direction subsequent to a predetermined rotative displacement of said seat support member in a direction opposite said one direction for folding said spine support member into adjacent relationship with said seat support member and subsequent displacement of said seat support member into contiguous relationship with said base frame.

20. The displaceable seat exercise system as recited in claim 19 where said seat means includes (a) arm member support means coupled to said seat support member and having portions thereof extending from opposing sides of said seat support member, and (b) a pair of arm members respectively rotatively coupled to said extending portions of said arm member support means for rotation by a user's hands independent of said rotative displacement of said seat means.

21. The displaceable seat exercise system as recited in claim 20 where said arm member support means includes an arm support member pivotally coupled to said seat support member and respectively rotatively coupled on opposing ends thereof to said pair of arm members, said seat means further including (a) a rod member fixedly coupled to said spine support member adjacent said one end of said spine support member and extending from opposing sides thereof, and (b) a fold link member having opposing first and second ends, said first end of said fold link member being pivotally coupled to said arm support member and said second end of said fold link member being pivotally coupled to one end of said rod member for rotatively displacing said arm support member responsive to said folding of said spine support member.

22. A displaceable seat exercise system, comprising:

a base frame extending longitudinally between opposing first and second ends;

foot support means fixedly coupled to said first end of said base frame;

seat means rotatively coupled to said second end base frame, said seat means including (a) a seat support means extending longitudinally between opposing front and rear ends thereof for supporting a buttock portion of a user's body, said rear end of said seat support means being rotatively coupled to said second end of said base frame, and (b) spine support means coupled to said seat support means adjacent said rear end thereof for supporting a user's back;

first resistance means coupled between said base frame and said seat means for resisting a force applied by a user between said foot support means and said seat means to rotatively displace said seat means from a position proximate said foot support means;

arm member support means coupled to said seat support means and having portions thereof extending from opposing sides of said seat support means; and, a pair of arm members respectively rotatively coupled to said extending portions of said arm member support means for rotation by a user's hands independent of said rotative displacement of said seat means.

23. The displaceable seat exercise system as recited in claim 22 further comprising second resistance means coupled between each of said pair of arm members and each of said extending portions of said arm member support means for applying a force opposing rotation thereof.

24. The displaceable seat exercise system as recited in claim 1 where said spine support is rotatively displaceable to a second predetermined position in adjacent relationship with said seat support member for folding said seat means.

25. The displaceable seat exercise system as recited in claim 24 where said seat support member is displaceable into contiguous relationship with said base frame.

26. The displaceable seat exercise system as recited in claim 15 where said spine support is rotatively displaceable to a second predetermined position in adjacent relationship with said seat support member for folding said seat means.

27. The displaceable seat exercise system as recited in claim 26 where said seat support member is displaceable into contiguous relationship with said base frame.

28. The displaceable seat exercise system as recited in claim 27 where said foot support means includes a foot platform member disposed in spaced relationship with said front frame member, said front frame member being retractable into said rear frame member to position said foot platform member in overlaying relationship with said spine support member when said spine support member is in said second predetermined position and said seat support member is in contiguous relationship with said base frame for capturing said seat means between said base frame and said foot platform.

* * * * *